United States Patent [19]

Holland et al.

[11] 4,042,033

[45] Aug. 16, 1977

[54] COMBINATION SUBSURFACE SAFETY VALVE AND CHEMICAL INJECTOR VALVE

[75] Inventors: Warren E. Holland; Martin E. True, both of Houston, Tex.

[73] Assignee: Exxon Production Research Company, Houston, Tex.

[21] Appl. No.: 728,683

[22] Filed: Oct. 1, 1976

[51] Int. Cl.[2] ..... E21B 43/00; E21B 43/12

[52] U.S. Cl. ..... 166/310; 166/314; 166/321

[58] Field of Search ..... 166/321–324, 166/310, 314, 315

[56] References Cited

U.S. PATENT DOCUMENTS

| | | | |
|---|---|---|---|
| 2,654,436 | 10/1953 | Carlisle et al. | 166/310 |
| 2,852,080 | 9/1958 | Roach | 166/310 |
| 2,928,471 | 3/1960 | Jones | 166/310 |
| 3,104,716 | 9/1963 | Burkhardt et al. | 166/310 |
| 3,675,720 | 7/1972 | Sizer | 166/322 |
| 3,712,862 | 1/1973 | Bundrant et al. | 166/310 |

*Primary Examiner*—James A. Leppink
*Attorney, Agent, or Firm*—Yale S. Finkle

[57] ABSTRACT

A surface controlled subsurface safety valve for controlling fluid flow through a tubing string in an oil or gas well is combined with an injector valve, which is used for injecting a chemical fluid into the tubing string. The pressure exerted by the chemical fluid is used to operate both the injector valve and the subsurface safety valve. The injector valve is designed to open at an injection pressure equal to or greater than the pressure needed to hold the safety valve in its open position.

10 Claims, 4 Drawing Figures

COMBINATION SUBSURFACE SAFETY VALVE AND CHEMICAL INJECTOR VALVE

BACKGROUND OF THE INVENTION

1. Field of the Invention

This invention relates to injector valves and subsurface safety valves and is particularly concerned with an apparatus and method that combines these valves so that they are operated by the same fluid.

2. Description of the Prior Art

Surface controlled subsurface safety valves have been used to control the flow of production fluids from a producing formation to the surface of an oil or gas well. These valves are normally controlled by means of fluid pressure applied from a surface fluid pressure source through a fluid control conduit, such as a small tubing that runs from the fluid source through the wellhead into the annulus between the tubing string and the well casing and to the valve. Water, brine, oil, gas or a similar inexpensive and readily available fluid is normally used to control the safety valve.

An injector valve may be incorporated somewhere in the tubing string of a well so that chemicals can be periodically or continuously injected into the tubing string when the well is producing. Such will be the case when it is desired to inject corrosion inhibitors to prevent or alleviate excess corrosion of the tubing string and the wellhead, or when it is desired to inject a solvent to prevent or alleviate the crystallization and subsequent deposition on the tubing string of paraffins, asphaltenes, sulfur, carbonates, sulfates and similar salts from the well fluids as they are produced through the tubing string. The chemical fluid, like the fluid that controls a subsurface safety valve, is normally supplied to the injector valve from a surface pressure source through a conduit, such as a small tubing that passes from the pressure source through the wellhead into the annular space between the tubing string and the well casing and to the injector valve. When it is desired to inject the chemical fluid, fluid pressure is exerted on the injector valve so that it opens and allows the chemical fluid to flow into the tubing string.

Heretofore, in situations where it was desirable to have both an injector valve and a subsurface safety valve incorporated into the same tubing string, it was necessary to have two separate surface fluid pressure sources—one to control the safety valve and the other to supply the chemical fluid to the injector valve. Each of these fluid pressure sources required its own fluid conduit connecting it to the valve it was operating. Therefore, two separate flange assemblies were required on the wellhead so that the separate fluids could be injected through the wellhead into their individual fluid conduits.

In certain instances the use of two fluid conduits in a well may be impractical because of space limitation. Further, in high pressure gas fields that contain large amounts of corrosive fluids, such as hydrogen sulfide and carbon dioxide, the wellheads are designed to withstand the high gas pressures and are therefore very expensive. Any decrease in the number of flange assemblies required on a wellhead will significantly decrease the cost of the wellhead. Since a well drilled in such high pressure gas fields will produce large amounts of corrosive fluids, the injector valve for injecting corrosion inhibitors into the tubing string cannot be omitted to thereby eliminate its associated flange assembly and fluid conduit. Similarly, the existance of high pressures in such a well dictates the need to control the flow of well fluids and therefore the subsurface safety valve cannot be omitted to thereby eliminate its associated flange assembly and fluid control conduit. It can be seen from the above discussion that in some instances it is desirable to eliminate a second flange assembly and a second fluid conduit from a well and at the same time retain both the injector valve and the subsurface safety valve.

SUMMARY OF THE INVENTION

This invention provides an apparatus and method that accomplishes the need referred to above. In accordance with the invention, it has now been found that a fluid control conduit and its associated wellhead flange assembly that would ordinarily be needed to supply a subsurface safety valve with its pressure control fluid can be eliminated from a well that also contains an injector valve or similar injection means by using the chemical fluid that operates the injector valve as the control fluid for the subsurface safety valve. The chemical fluid is supplied to the safety valve through the same conduit that is used to supply the fluid to the injector valve, thereby eliminating the necessity for a separate conduit and control fluid for operating the subsurface safety valve.

The apparatus constituting the invention includes a surface controlled subsurface safety valve for controlling fluid flow through a tubing string in an oil or gas well combined with an injector valve or similar injection means for injecting a chemical fluid into the tubing string. The pressure exerted by the chemical fluid is used to open both the injector valve and the subsurface safety valve. The injector valve is designed to open at an injection pressure equal to or greater than the pressure needed to hold the safety valve in the open position. When the injector valve is designed to open at a pressure greater than that needed to open the safety valve, the chemical fluid can be injected as desired by increasing the pressure of the chemical fluid in the fluid control conduit sufficiently to open the injector valve.

DESCRIPTION OF THE PREFERRED EMBODIMENT

Figure 1:
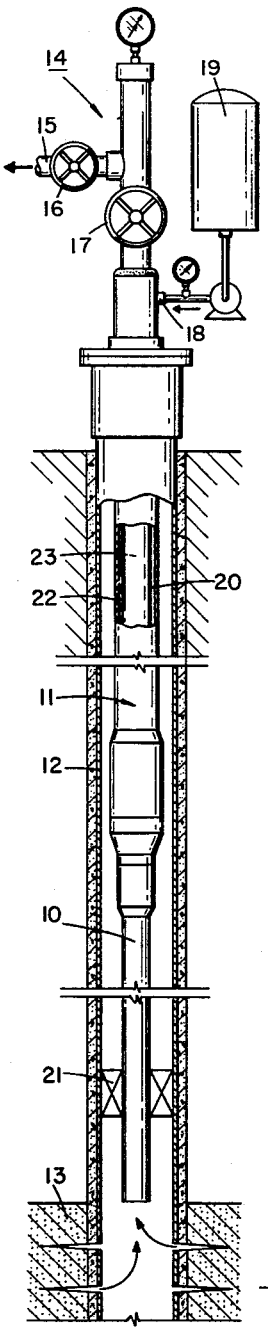
FIG. 1 is a schematic sectional view showing the apparatus of the invention incorporated in the tubing string of a well.

The oil or gas well shown in FIG. 1 includes a tubing string comprised of a tubing 10 and a double wall pipe 11 suspended in a well casing 12. Double wall pipe 11 is composed of two concentric pipes, outer pipe 22 and inner pipe 23. Well fluids flow upward from a subsurface producing formation 13 through the tubing string to a wellhead, generally designated by reference number 14. The wellhead includes a production flowline 15 in which is located a valve 16, a master control valve 17 and a flange assembly 18. A source of chemical fluid 19 is connected to the wellhead by flange assembly 18 in such a manner as to be in fluid communication with a fluid conduit 20, which is the annular space between inner and outer pipes 23 and 22 that comprise the double wall pipe portion 11 of the tubing string. A packer 21 seals the annulus between tubing 10 and well casing 12, thereby forcing the flow of well fluids up through the tubing string to the wellhead.

Figure 2:
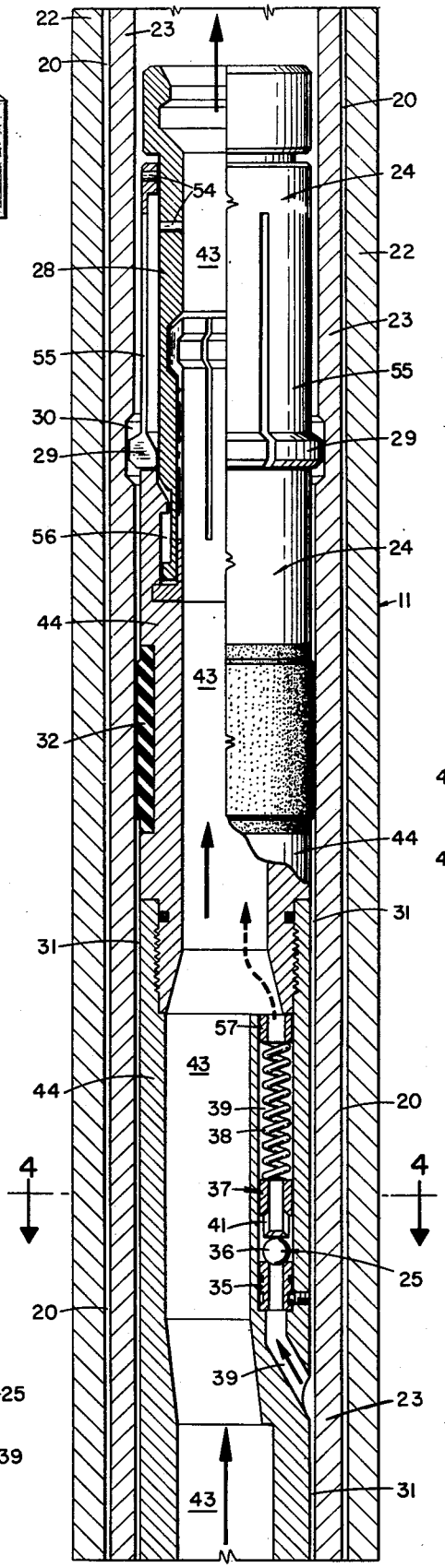
FIG. 2 is a schematic sectional view of the upper portion of the apparatus of the invention showing the injector valve.
Figure 3:
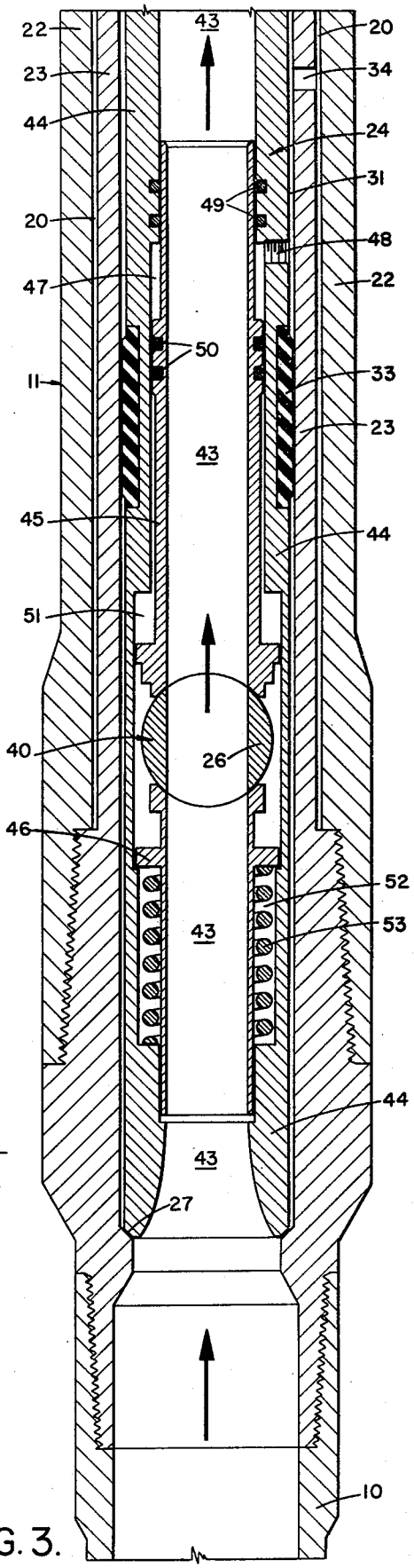
FIG. 3 is a continuation of FIG. 2 showing the lower portion of the aparatus of the invention, which contains the subsurface safety valve.

FIGS. 2 and 3 show an enlarged sectional view of the double wall pipe portion 11 of the tubing string with a tubular member 24 disposed therein. Tubular member 24 is comprised of a housing 44 that contains a flow passageway 43, which is in fluid communication with the passageway of tubing 10. The upper portion of tubular member 24, which contains an injector valve or similar injection means 25, is shown in FIG. 2. The lower portion of the tubular member shown in FIG. 3 contains a subsurface safety valve 40. Tubular member 24 may be wireline insertable into and removable from the tubing string. To insert the tubular member, it is passed downward through master valve 17 of the wellhead and lowered into inner pipe 23 until it becomes seated on a shoulder 27, which is formed at the lower end of pipe 23. Once seated, the tubular member is locked in place by forcing a locking mandrel 28 into its down position, which is shown in FIG. 2. Before locking occurs, the locking mandrel is held in its up position by a shear pin 54. Sufficient force is exerted on the mandrel by jars to break the shear pin and move the mandrel downward. As the mandrel moves downward, it forces locking dogs 29 outward into annular recess 30 thereby locking tubular member 24 in place inside inner pipe 23. To unlock the tubular member, locking mandrel 28 is pulled upward by wireline means so that spring fingers 55 can force locking dogs 29 out of annular recess 30 into a groove 56 located at the bottom of the mandrel.

When locked in place tubular member 24, together with inner pipe 23, forms a passageway 31, which is sealed off by an upper packer 32 shown in FIG. 2 and a lower packer 33 shown in FIG. 3. Passageway 31 is connected to fluid conduit 20 by means of a port 34.

Details of injector valve 25, which is incorporated into housing 44 of tubular member 24, are shown in FIG. 2. A channel 39 formed in housing 44 is in fluid communication with passageway 31 at its lower end and with flow passageway 43 at its upper end. In channel 39 a valve ball 36 is held firmly in place on top of a hollow valve seat 35 by a hollow valve sleeve 37, which has slits or openings 41. The valve sleeve is urged downward by spring 38, which is held in place at its upper end by a hollow spring retainer sleeve 57. Injector valve 25 is shown in FIG. 2 in its closed position. The valve is opened when the fluid pressure in channel 39 is increased to a level sufficient to force valve ball 36 out of valve seat 35 by compressing spring 38. Once the valve ball is forced out of its seat, flow passageway 43 is put in fluid communication with passageway 31 via channel 39.

Figure 4:
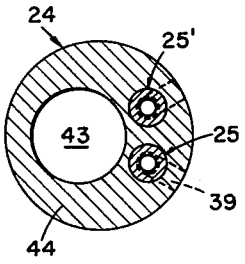
FIG. 4 is a horizontal cross-sectional view of the injector valve taken on line 4—4 of FIG. 2.

As can be seen in FIG. 4, housing 44 of tubular member 24 contains two injector valves. Valve 25' is identical in structure to valve 25. The actual number of injector valves used will depend primarily on the amount of the chemical fluid it is desired to inject into flow passagesay 43. It will be understood that the apparatus of the invention is not restricted to the design of the injector valve shown in FIG. 2. Any injector valve or similar injection means that operates in such a fashion to preclude a chemical fluid from entering the tubing string until a predetermined fluid pressure level is reached may be used. Such injector means are described in the literature and therefore will be familiar to those skilled in the art.

Details of subsurface safety valve 40, which is disposed inside housing 44 of tubular member 24, are shown in FIG. 3. An upper valve sleeve 45 together with housing 44 forms a pressure chamber 47, which is in fluid communication with passageway 31 via an inlet port 48 formed in housing 44. Upper O-rings 49 on housing 44 and lower O-rings 50 on valve sleeve 45 seal off the upper and lower ends of pressure chamber 47. Upper valve sleeve 45 is slidable reciprocally within housing 44 and when in its down position forms, together with housing 44, chamber 51. A lower valve sleeve 46, like upper valve sleeve 45, is slidable reciprocally within housing 44 and forms, together with housing 44, a chamber 52, whiich contains a spring biasing member 53. Spring biasing member 53 urges lower valve sleeve 46 upward against a ball valve 26, which is seated between upper valve sleeve 45 and lower valve sleeve 46. When both the upper and lower valve sleeves are held in their lowermost position by the fluid pressure in chamber 47, as is shown in FIG. 3, the ball valve is open and will allow producing fluids to flow through the tubing string. When, however, spring biasing member 53 forces both the upper and lower sleeves into their upwardmost positions, the ball valve closes, thereby cutting off the flow of production fluids through flow passageway 43. Ball valve 26 is constructed similarly to standard ball valves used in oil or gas wells and therefore will be familiar to those skilled in the art.

It will be understood that the apparatus of the invention is not restricted to the particular subsurface safety valve shown in FIG. 3. Any standard type safety valve, including safety valves containing closure mechanisms other than a standard ball valve, that is operated or controlled by a control fluid from a fluid pressure source located at the surface of the well may be used. Such safety valves are described in the literature and therefore will be familiar to those skilled in the art.

The apparatus of the invention makes it possible to use a chemical fluid not only to supply an injector valve or similar injection means but also to operate a subsurface safety valve. The use of a chemical fluid in this dual fashion permits the elimination of a separate fluid control conduit and its associated wellhead flange assembly that would otherwise be needed to supply a subsurface safety valve with its individual pressure control fluid.

When the apparatus of the invention depicted in FIGS. 1 through 4 is in operation, a chemical fluid is supplied to injector valves 25 and 25' from fluid source 19 via fluid conduit 20, port 34, passageway 31, and channel 39. Similarly, the chemical fluid is supplied to chamber 47 of safety valve 40 from fluid source 19 through fluid conduit 20, port 34, passageway 31, and port 48. The chemical fluid in pressure chamber 47 forces upper and lower valve sleeves 45 and 46 downward to their lowermost position as shown in FIG. 3. When the valve sleeves are in this position, ball valve 26 is held in its fully open position. This open position is maintained so long as sufficient fluid pressure to overcome th bias of spring 53 is supplied to the upper valve sleeve from fluid pressure source 19. If the fluid pressure in chamber 47 decreases, lower and upper valve sleeves 46 and 45 will move upward under the bias of spring 53, thereby causing ball valve 26 to close. The safety valve is designed so that ball valve 26 is in its fully open position when the pressure applied from fluid source 19 is equal to a predetermined value. When the apparatus of the invention is utilized in high pressure, sour gas wells, this value may be as much as about 400 pounds per square inch above the pressure inside flow passageway 43 at ball valve 26.

Although the apparatus shown in the drawings may be designed so that the injector valve 25 will open and allow injection of fluid when the pressure applied from fluid source 19 is equal to the pressure needed to hold safety valve 40 in its open position, it is preferred that the injector valve not open unless the pressure is greater than that needed to hold the safety valve open. To accomplish the latter, spring 38 is designed such that it will compress only when the pressure applied on valve ball 36 is higher, preferably from about 20 to about 100 pounds per square inch higher, than the pressure needed to hold the safety valve in its fully open position. When it is desired to inject chemical fluid, the pressure from source 19 is increased from the level needed to maintain safety valve 40 in its open position to a value sufficient to overcome the biasing force of spring 38. Ball 36 is thereby lifted from seat 35 against hollow valve sleeve 37, which compresses spring 38. The chemical fluid flows through open channel 39 into flow passageway 43 where the chemical fluid mixes with the production fluids.

The chemical fluid supplied to the injector and safety valves from fluid source 19 may be any gas, liquid, or mixture of gases or liquids that it is desired for any reason to inject into the tubing string. For example, the chemical fluid may be a hydrocarbon gas injected into the tubing string where it may serve as a gas lift agent to decrease hydrostatic head thereby increasing production rates. Normally, the chemical fluid will be an agent for treating the fluids being produced by the well. If such is the case, the actual substance used as the chemical fluid will depend on, among other factors, the type of well being produced, the chemical nature of the fluids being produced, and the temperature and pressure conditions extant in the well. For example, if the well fluids contain paraffins, asphaltenes, sulfur or other substances that may crystallize during production and foul the tubing string and wellhead, it may be desirable to employ a solvent that will prevent or alleviate such crystallization as the chemical fluid. Likewise, if the produced fluids contain hydrogen sulfide, carbon dioxide or other corrosive substances, a corrosion inhibitor dissolved in some type of carrier liquid such as water, diesel oil, condensate, or the like may be used as the chemical fluid. In addition an emulsion breaker may be used as the chemical fluid if it is desirable to enhance the separation of oil and water during production.

As described above and shown in the drawings, a chemical fluid is used to operate both a subsurface safety valve and an injector valve, both of which are incorporated in a tubular member that is inserted by wireline into the upper portion of the tubing string. The fluid is supplied to the safety and injector valves through a fluid conduit formed by the annular space between two concentric pipes. It will be understood that any type of fluid conduit that will supply the chemical fluid simultaneously to both the subsurface safety valve and the injector valve may be used in lieu of the concentric pipe system shown in the drawings. For example, a small diameter tubing may be run from the fluid source through the annulus between the tubing string and well casing to each of the valves. It will be further understood that instead of including both valves in a tubular member that is placed in the upper portion of the tubing string, the valves can each be incorporated in the tubing string itself at any desired depth. Other changes and modifications may be made in the illustrated embodiment of the invention shown and described herein without departing from the scope of the invention as defined in the appended claims.

It should be apparent from the foregoing that the invention provides an apparatus and method in which a subsurface safety valve is operated by the same chemical fluid that supplies an injector valve or similar injection means.

We claim:

1. An apparatus for controlling the flow of fluids through the tubing string of a well and for injecting a chemical fluid into said tubing string which comprises:

a. a pressure responsive, fluid controlled safety valve;

b. pressure responsive injector means for injecting said chemical fluid into said tubing string of said well; and c. conducting means, connected to said injector means, for supplying said chemical fluid to said injector means, said conducting means also being connected to said safety valve whereby said chemical fluid serves as the pressure control fluid for said safety valve.

2. An apparatus as defined by claim 1 wherein said injector means comprises an injector valve.

3. An apparatus as defined by claim 1 wherein said chemical fluid comprises a corrosion inhibitor.

4. An apparatus as defined by claim 1 wherein said conducting means comprises a small diameter tubing.

5. An apparatus as defined by claim 1 wherein at least a portion of said tubing string is comprised of two concentric pipes and the annular space between said pipes serves as said conducting means.

6. An apparatus as defined by claim 1 wherein the pressure required to inject said chemical fluid into said tubing string is greater than the pressure required to hold said safety valve in its open position.

7. A method for simultaneously operating a pressure responsive, subsurface safety valve that controls the flow of fluids through the tubing string of a well and a pressure responsive injector valve for injecting a chemical fluid into said tubing string which comprises:

a. supplying said chemical fluid simultaneously to said safety and injector valves; and b. exerting sufficient pressure on said safety valve and said injector valve by means of said chemical fluid to hold said safety valve in its open position and to open said injector valve.

8. A method as defined by claim 7 wherein said chemical fluid comprises a gaseous gas lift agent.

9. A method as defined by claim 7 wherein said chemical fluid comprises an emulsion breaker.

10. A method as defined by claim 7 wherein said chemical fluid comprises a solvent.

* * * * *